US007179137B1

(12) United States Patent
Quendt et al.

(10) Patent No.: US 7,179,137 B1
(45) Date of Patent: Feb. 20, 2007

(54) ELECTRICAL CONNECTOR ARRANGEMENT

(75) Inventors: Eckardt Quendt, Wutha-Farnroda (DE); Marcell Nickol, Creuzburg/Scherbda (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/496,132

(22) Filed: Jul. 31, 2006

(30) Foreign Application Priority Data

Aug. 18, 2005 (DE) ..... 20 2005 013 056 U

(51) Int. Cl.
*H01R 4/48* (2006.01)

(52) U.S. Cl. ..... 439/828; 439/907

(58) Field of Classification Search ..... 439/828, 439/829, 835, 907
See application file for complete search history.

(56) References Cited

U.S. PATENT DOCUMENTS 5,318,461 A 6/1994 Frikkee et al.
5,411,417 A 5/1995 Horn et al.
5,658,172 A 8/1997 Schmidt et al.
5,755,822 A * 5/1998 Scheffner ..... 439/490
5,853,304 A * 12/1998 Landreau et al. ..... 439/721
5,879,204 A 3/1999 Delarue et al.
5,890,916 A * 4/1999 Diekmann et al. ..... 439/94
5,938,484 A 8/1999 Beege et al.
6,183,311 B1 * 2/2001 Suess et al. ..... 439/716
6,392,319 B1 * 5/2002 Zebermann et al. ..... 307/147
6,464,545 B2 * 10/2002 Yano ..... 439/828
6,663,441 B1 * 12/2003 Alexandre et al. ..... 439/715
6,689,955 B2 * 2/2004 Doutaz ..... 174/652
6,736,683 B2 * 5/2004 Brand et al. ..... 439/828
6,786,779 B2 * 9/2004 Feldmeier et al. ..... 439/729

* cited by examiner

*Primary Examiner*—Tulsidas C. Patel
*Assistant Examiner*—Vladimir Imas
(74) *Attorney, Agent, or Firm*—Lawrence E. Laubscher, Sr.; Lawrence E. Laubscher, Jr.

(57) ABSTRACT

An electrical connector arrangement includes slidably connected upper and lower connector body sections, at least one pair of first contacts carried by the upper body section, at least one pair of second contacts of the pin type carried by the lower body section beneath the first contacts, respectively, and a third contact arranged on the upper section body section for connecting the pairs of first and second contacts, the third contact having two upwardly extending arm portions in engagement with the two first contacts, respectively, and three downwardly extending spaced leg portions that define a pair of gaps that receive the two pin second contacts, respectively. A plurality of the first, second and third contacts are arranged in parallel rows on the upper and lower connector sections.

10 Claims, 2 Drawing Sheets

Fig. 2
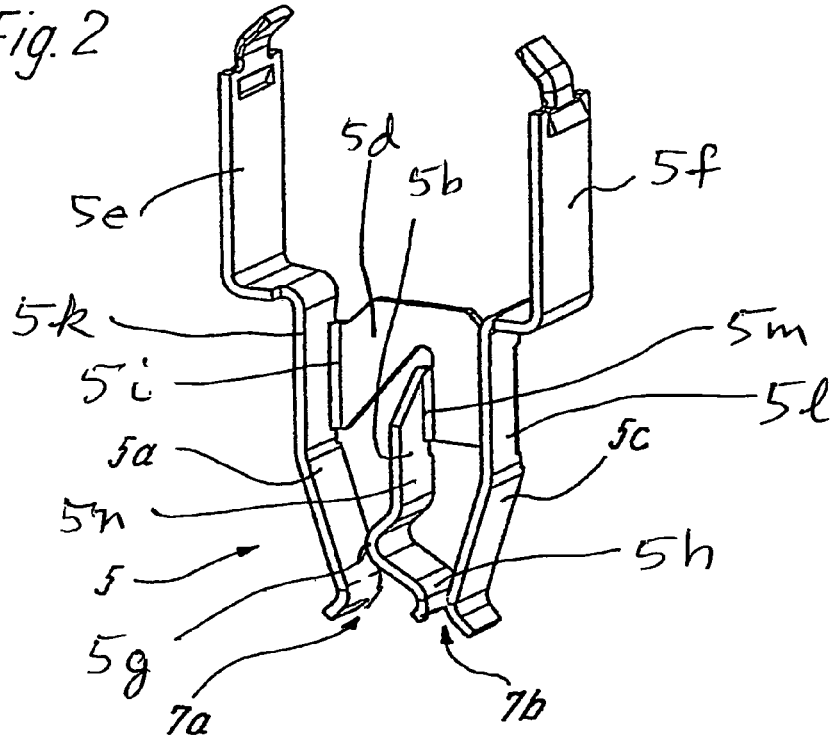
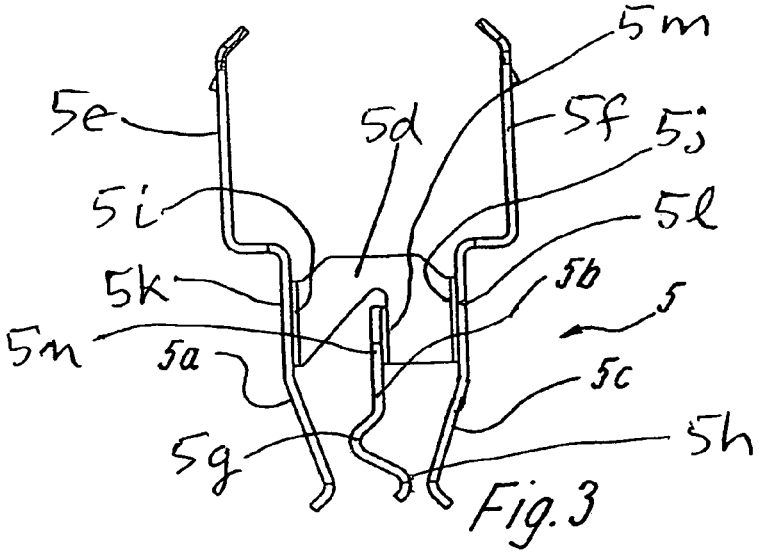
Fig. 3
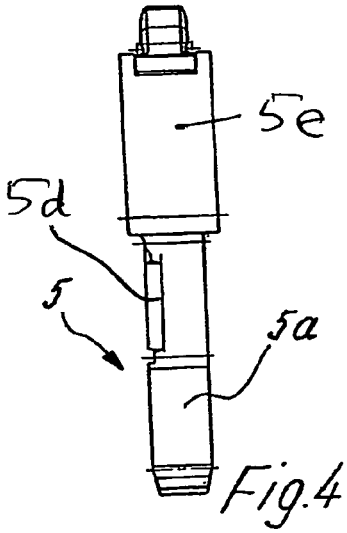
Fig. 4

ELECTRICAL CONNECTOR ARRANGEMENT

BACKGROUND OF THE INVENTION

1. Field of the Invention

An electrical connector arrangement includes slidably connected upper and lower connector body sections, at least one pair of first contacts carried by the upper section, at least one pair of second contacts of the pin type carried by the lower body section beneath the first contacts, respectively, and a third contact arranged on the upper section body section for connecting the pairs of first and second contacts, said third contact having two upwardly extending arm portions in engagement with the two first contacts, respectively, and three downwardly extending spaced resilient leg portions that define a pair of gaps that receive the two pin second contacts, respectively.

2. Description of Related Art

Electrical connectors of the pin and socket type are well know in the patented prior art, as shown by the patents to Frikkee et al No. 5,318,461, Horn et al No. 5,411,417, and Scheffner No. 5,755,822, among others. It is also known to provide resilient contacts for engaging bare conductors and to press the same against bus bars, as shown by the patents to Schmidt et al No. 5,658,172, Delarue et al No. 5,879,204, Dickmann et al No. 5,890,916, Beege et al No. 5,938,484, Wielsch et al No. 6,270,383, and Despang No. 6,350,162, among others.

The present invention was developed to provide a connector arrangement of the type involved here, where one can bring about the connection of two side-by-side insulated conductors associated with the connector socket body section with a pair of contact pins on the connector pin body section in a simple manner in terms of design, and at a reasonable cost.

SUMMARY OF THE INVENTION

Accordingly, a primary object of the invention is to provide an electrical connector arrangement including a pair of slidably connected upper and lower connector body sections, at least one pair of first contacts carried by the upper section, at least one pair of second contacts of the pin type carried by the lower body section beneath the first contacts, respectively, and a third contact arranged on the upper section body section for connecting the pair of first contacts with the pair of pin second contacts, said third contact having two upwardly extending arm portions in engagement with the two first contacts, respectively, and three downwardly extending spaced resilient leg portions that define a pair of gaps that receive the two pin second contacts, respectively.

According to another object of the invention, the third contact is formed from a single sheet of conductive material by punching, stamping and bending, thereby to produce the contact in an inexpensive manner. A pair of outer wing portions bent orthogonally from a base plate carry the upwardly extending arm portions and the downwardly extending outer leg portions. A central wing portion that is orthogonally bent from the planar base portion carries the downwardly extending middle lower leg portion.

According to a further object of the invention, the resilient outer lower leg portions cooperate with the lower middle leg portion to apply substantially equal electrical engagement forces on the lateral surfaces of the pin second contacts. To effect positive engagement with the pin contacts, the middle conductor may be deformed to define either a serpentine or a stepped longitudinal cross-sectional configuration, thereby to provide a pair of vertically spaced convex surfaces that are oppositely directed outwardly into engagement with the adjacent surfaces of the pin contacts, respectively.

BRIEF DESCRIPTION OF THE DRAWINGS

Other objects and advantages of the invention will become apparent from a study of the following specification, when viewed in the light of the accompanying drawing, in which:

FIG. 2 is a front perspective view of one of the electrical contacts of the connector assembly of FIG. 1; and FIGS. 3 and 4 are front and left side elevation views of the contact of FIG. 2.

DETAILED DESCRIPTION OF THE INVENTION

Figure 1:
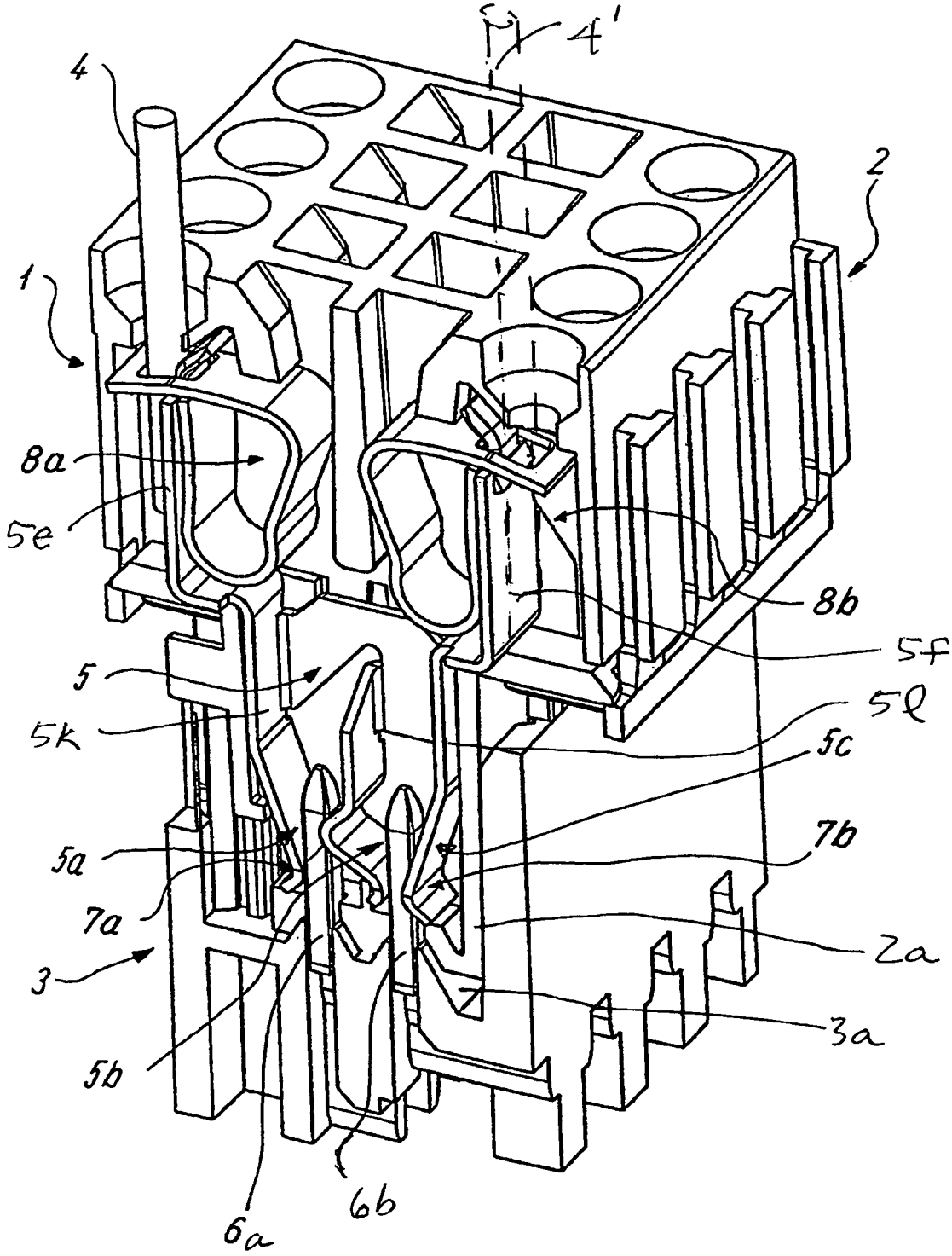
FIG. 1 is a front perspective view of the electrical connector assembly of the present invention.

Referring first more particularly to FIG. 1, the connector assembly of the present invention includes a connector body 1 formed of a suitable synthetic plastic insulating material comprising a pair of sections 2 and 3 that are slidably connected for relative vertical displacement, the upper section including a downwardly projecting portion 2*a* that extends within a corresponding recess 3*a* contained in the upper end of the lower body section. The upper body section 2 is hollow and contains a plurality of resilient first electrical contacts 8*a*, 8*b* arranged in parallel spaced rows above corresponding rows of a plurality of stationary vertical pin-type second contacts 6*a*, 6*b* that are carried by the lower body section and that extend upwardly within the recess 3*a*. The two first contacts 8*a* and 8*b* are electrically connected with the corresponding two second contacts 6*a*, 6*b* by a third contact element 5 that is arranged within the downwardly projecting portion 2*a* of the upper body section.

As shown in FIGS. 2–4, the third contact 5 includes three leg portions 5*a*, 5*b*, and 5*c* that are integral with and extend vertically downwardly from the conductive planar base portion 5*d*. These three leg portions define a pair of gaps 7*a* and 7*b* that receive the pin second contacts 6*a* and 6*b*, respectively, that are carried by the lower body section. The third contact also includes a pair of upwardly extending arm portions 5*e* and 5*f* that are electrically connected with the associated second contacts 8*a* and 8*b*, as will be explained below. Thus, the upper connector body 2 comprises a socket body with the lower leg contacts 5*a*, 5*b* and 5*c* defining a female socket arrangement, and the lower body section comprises a pin connector body with a corresponding male pin arrangement 6*a* and 6*b*.

As best shown in FIG. 3, in accordance with an important feature of the invention, the third contact 5 includes a pair of integral outer wing portions 5*k* and 5*l* that are bent orthogonally from the side edges of the base portion 5*d* about a pair of fold lines 5*i* and 5*j*, respectively. The upper arm portions 5*e* and 5*f* are integral with and extend upwardly from the wing portions 5*k* and 5*l*, respectively, and the outer lower leg portions 5*a* and 5*c* are integral with and extend downwardly from the wing portions 5*k* and 5*l*, respectively. A center wing portion 5*n* is folded orthogonally relative to the base portion 5*d* about a center fold line 5*m*. The resilient outer leg portions 5*a* and 5*c* are biased inwardly toward the middle leg portion 5*b*. In order to effect positive electrical contact with the pins 6*a* and 6*b* inserted into the gaps 7*a* and 7*b*, the middle leg portion 5*b* has a serpentine or stepped longitudinal cross-sectional configuration, thereby to define a pair of vertically spaced convex portions 5*g* and 5*h* that are oppositely directed outwardly toward the outer leg portions 5*a* and 5*b*, respectively.

Referring again to FIG. 1, the known resilient first contacts 8*a* and 8*b* contain openings for receiving the bare ends of insulated conductors 4 that are inserted through openings contained in the top wall of the upper socket connection.2. The contacts bias the conductors against the upper arm portions 5*e* and 5*f* of the third contact 5. The conductor 4*a* is connected with the pin 6*a* by the bus bar defined by the upper arm portions 5*e*, the wing portion 5*k*, and the lower leg portion 5*a*. Similarly, the conductor 4' is connected with the pin contact 6*b* via the bus bar defined by the upper leg portion 5*f*, the contact wing portion 5*l*, and the lower leg portion 5*c*. The convex portions 5*g* and 5*h* of the middle leg portion 5*c* engage the adjacent surfaces of the pin contacts 6*a* and 6*b*. Preferably, the resilient biasing forces exerted by the outer leg portions 5*a* and 5*c* relative to the middle lower leg portion 5*b* are equal.

Operation

Assume that it is desired to connect a pair of insulated conductors 4, 4' with the pins 6*a* and 6*b* of a printed circuit board or the like. The first contacts 8*a*, 8*b* are compressed (by the tip of a screwdriver, for example), whereupon the bare conductor ends are inserted through the connector openings and into the first contact openings. The first contacts are then released, whereupon the bare conductor ends are biased into electrical engagement with the arm portions 5*e* and 5*f*, respectively, so that the arm portions 5*e* and 5*f* are connected with both pin contacts 6*a* and 6*b* via the wing portions 5*k* and 5*l* and the lower leg portions 5*a*, 5*b* and 5*c*. Similarly, other pairs of insulated conductors (not shown) may be inserted in the other openings contained in the top surface of the upper socket connector body 2 for connection with corresponding pin-type second contacts supported by the lower connector body via third contacts.

Preferably, the third contact 5 is formed from a single sheet of copper alloy or other conducting metal. By means of the present invention, it is also possible in the simplest fashion and also by way of low-cost production in each case to contact two contact pins 6, arranged next to each other in pairs, with a single contact element 5 having three contact legs 5*a*. 5*b*. and 5*c*.

Connector devices 1 of the kind described can advantageously be used in the socket area for "looping through" a signal. The contact between the contact pins is positively assured without the requirement of any additional parts. The assembly of the entire contact system is also simplified by the described design, in particular, no unsafe welding processes are required. The construction of the present invention also facilitates the transmission of high voltages and/or currents.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector for connecting a pair of conductors with a pair of pin contacts, comprising:

(a) a sectional connector body (1) including a hollow upper socket section (2), and a hollow lower pin section (3) arranged below and connected for vertical sliding movement relative to said upper socket section;

(b) a pair of first electrical contacts (8*a*, 8*b*) mounted in said upper socket section;

(c) a pair of second electrical contacts (6*a*, 6*b*) mounted in said the upper portion of said lower pin section below said first contacts, respectively, said second contacts comprising vertical pin contacts; and (d) third electrical contact means (5) connecting said pair of first contacts with said pair of second contacts, said third contact means comprising a conductive member including:

(1) a planar base portion (5*d*);

(2) three lower leg portions (5*a*, 5*b*, 5*c*) extending downwardly in spaced relation from said base portion, the lower ends of said leg portions defining a pair of gaps (7*a*, 7*b*) opposite said second contacts, respectively, said second contacts extending into said gaps in electrical engagement with said leg portions; and (3) a pair of upper arm portions (5*e*, 5*f*) extending upwardly in electrical engagement with said first contacts, respectively.

2. An electrical connector as defined in claim 1, wherein said third contact lower leg portions and upper arm portions are integral with said base portion.

3. An electrical connector as defined in claim 2, wherein each of said first contacts is resilient and includes a pair of clamping portions that are operable to bias a bare conductor (4, 4') into electrical engagement with an associated one of said first contacts.

4. An electrical connector as defined in claim 2, wherein said third contact lower leg portions are resilient and generally coplanar, the outer two of said leg portions being biased inwardly toward the middle one of said leg portions.

5. An electrical connector as defined in claim 4, wherein said middle leg portion includes a pair of vertically-spaced oppositely-bent convex portions (5*g*, 5*h*) that extend horizontally outwardly toward engagement with said outer leg portions, respectively.

6. An electrical connector as defined in claim 5, wherein said third contact comprises a vertical generally-rectangular stamped metal plate including a pair of outer wing portions (5*k*, 5*l*) bent outwardly from the side edges (5*l*, 5*j*) of, and extending orthogonally from the same side as, said base portion, said upper arms portions and said outer lower leg portions extending upwardly and downwardly from said wing portions, respectively.

7. An electrical connector as defined in claim 6, wherein said third contact base portion contains a slot defining a central vertical edge, and further including a vertical central wing portion (5*n*) bent orthogonally outwardly from said central vertical edge about a vertical fold line (5*m*), said central wing portion extending between and parallel with said outer wing portions, said third contact middle leg portion extending downwardly from said central wing portion between said outer leg portions.

8. An electrical connector as defined in claim 7, wherein said third contact outer leg portions are biased with equal force inwardly toward said middle leg portion, thereby to produce equal biasing contact force on said pin second contacts.

9. An electrical connector as defined in claim 1, wherein said lower pin section has an upper end containing a recess (2*a*), said pin contacts extending upwardly within said recess; and further wherein said upper socket section includes a downwardly projecting portion (1*a*) that extends within said chamber, said third contact lower leg portions being contained within said downwardly projecting upper section portion for engagement with said pin contacts.

10. An electrical connector as defined in claim 1, wherein a plurality of said first contacts are arranged in two parallel spaced rows; wherein a plurality of said second contacts are arranged in two parallel spaced rows below said first contacts, respectively; and further wherein a plurality of spaced third contacts are arranged in a row between and parallel with said first and second contacts, each of said third contacts being electrically connected with one contact of each of said four rows.

* * * * *